US006276409B1

(12) United States Patent
Ellison

(10) Patent No.: US 6,276,409 B1
(45) Date of Patent: Aug. 21, 2001

(54) CONTAINER FEED AND IN-LINE FILLER SYSTEM

(75) Inventor: Thomas E. Ellison, Pasadena, CA (US)

(73) Assignee: Biner-Ellison Package Manufacturing Company d/b/a Ellison Packaging Systems, Inc., Los Angeles, CA (US)

( * ) Notice: Subject to any disclaimer, the term of this patent is extended or adjusted under 35 U.S.C. 154(b) by 0 days.

(21) Appl. No.: 09/187,450

(22) Filed: Nov. 5, 1998

(51) Int. Cl.[7] ..... B65B 1/04
(52) U.S. Cl. ..... 141/234; 141/237; 141/178
(58) Field of Search ..... 141/234, 165, 141/169, 170, 171, 178, 180, 237, 246, 129

(56) References Cited

U.S. PATENT DOCUMENTS

| | | | |
|---|---|---|---|
| 2,636,592 | 4/1953 | Socke . | |
| 2,648,421 | 8/1953 | Vitz . | |
| 2,951,574 | 9/1960 | Craig . | |
| 3,193,079 | 7/1965 | Winter, IV et al. . | |
| 3,250,371 | 5/1966 | Cella et al. . | |
| 3,265,182 | 8/1966 | Bargel . | |
| 3,407,916 | 10/1968 | Engeler . | |
| 3,625,336 | 12/1971 | Fuwa et al. . | |
| 3,887,060 | 6/1975 | Kamphues | 198/30 |
| 4,034,846 | 7/1977 | Burgis et al. | 198/422 |
| 4,043,461 | 8/1977 | Castro | 214/6 B |
| 4,165,809 | 8/1979 | Klein et al. | 414/104 |
| 4,273,236 | 6/1981 | Wahl et al. | 198/432 |
| 4,610,347 | 9/1986 | Inoko | 198/425 |
| 4,697,691 | 10/1987 | Zodrow et al. | 198/425 |
| 4,861,225 | 8/1989 | Dorner et al. | 414/789.9 |
| 5,039,276 | 8/1991 | Leuvering | 414/795.3 |
| 5,174,430 | 12/1992 | Ebira | 198/418.5 |
| 5,244,330 | 9/1993 | Tonjes | 414/331 |
| 5,305,809 * | 4/1994 | Pringle | 141/237 |

* cited by examiner

*Primary Examiner*—Steven O. Douglas
(74) *Attorney, Agent, or Firm*—Oppenheimer Wolff & Donnelly LLP

(57) ABSTRACT

A container feed and in-line filler system comprises an organizer including a conveyor and guide rails and a stop for organizing containers to be filled with a flowable material into rows and files, and a filler rack carried above the organizer whereby empty containers being organized are filled before being transferred out of the organizer.

20 Claims, 7 Drawing Sheets

105
CONTROLLER
118
MEMORY
116
PROCESSOR
104
USER INTERFACE
CLOCK
120
122
POWER SUPPLY
TRANSVERSE CONVEYOR CONTAINER SENSOR
110
CONVEYOR ACTUATOR
112
109
GATE ACTUATOR
TRANSVERSE CONTAINER ACTUATOR
114
108
FILLER VERTICAL POSITION SENSOR
FILL LEVEL SENSOR
111
107
VERTICAL ACTUATOR
FILL VALVE ACTUATOR
89
106
CONTAINER SENSOR
FILLER PUMP MOTOR
80

CONTAINER FEED AND IN-LINE FILLER SYSTEM

BACKGROUND

1. Field of the Invention

The invention relates generally to packaging systems for filling containers with flowable materials. More particularly, the invention relates to container feed apparatus and container filling apparatus for use in a product packaging line.

2. Description of Related Art

In conventional packaging processes where bottles or other containers are filled with flowable materials there is usually provided a container feed apparatus which organizes containers for introduction onto the line. For example containers from reshippers are deposited onto a feed table adjacent a series of parallel rails which organize the containers into files. By another means, for example pushing the containers against a transverse rail, they are organized into rows. In one arrangement a conveyor moving in a direction transverse to the organizing rails transfers the containers out onto the line one row at a time. The next bottle of each file then moves onto the transverse conveyor and up against the transverse rail, ready for transfer out onto the line.

Elsewhere on the line a filler awaits the empty containers and fills them in turn. In order to speed production fillers are constructed so as to fill multiple containers in each filling cycle. As is well known, such parallel processing increases production speed. However, containers coming from the feeder conventionally have to wait before transferring into the filler, and there is a required time for the containers to transfer out of the filler. The containers then are transferred to capping and labeling apparatus, as required.

SUMMARY OF THE INVENTION

It has been recognized that the time required for the empty containers to transfer in, and the filled containers to transfer out, of a filling station on a production line can be saved by combining the filling operation with the container feed operation. Since the containers are "stacked-up" in the feed operation in any case, so that they may be organized by row and/or file, it is possible to fill the containers at this location with appropriate configuration and control of the feed apparatus combined with fill apparatus placed over the feeder.

The invention accordingly provides a container feed and in-line container filler system comprising a support frame and a conveyor carried by the frame. The conveyor moves randomized containers in a first direction from a first side toward a second side, this can be in index motion. An organizer, supported by the frame and further comprising a set of guide rails which line up containers in files as the containers move in the first direction, is provided; and, a stop preventing further motion of the containers in the first direction cooperating with the guide rails and the conveyor to pack the containers into rows. A filling station is provided above the organizer, the filling station being adapted to fill a row of containers simultaneously. Also, a transverse conveyor intermediate the end rail and the second side of the conveyor, supported by the frame, is provided. Using this apparatus containers are organized into ranks and rows and filled in the organizer. The filled containers push the forwardmost containers onto the transverse conveyor as the conveyor is indexed.

The apparatus in a more detailed aspect can further comprise a feed table for receiving randomized containers adjacent the first end of the conveyor. At the second end a transverse conveyor and an end rail can be provided to receive the filled containers and transfer them to labeling and/or capping operations.

Further, gates can be provided which act as the stop to organize the containers into rows. The gates can be made to open and close in coordinated movement with the conveyor to insure the first and successive rows of containers are filled before transferring out onto the line. Alternatively an end rail adjacent the transverse conveyor can act as the stop, the containers stacking up against the end rail and thereby being organized into rows back through the organizer.

In a further detailed aspect many fillers can be arranged in line across the organizer which can be constructed so that many files of containers are created and organized into rows. The organizer can be made adjustable to accommodate different sized containers. The system can be provided with sufficient space between the fillers and the transverse conveyor that filled containers provide sufficient resistance to sliding with respect to the conveyor that they push the forwardmost row of containers onto the transverse conveyor.

In another detailed aspect the system can include redundant fluid filler feed pumps and manifolds so that one can be serviced while the other is in operation, facilitating rapid changeover from filling one product to another. Further, the location of the fillers and the stops can be made adjustable, which in combination with the adjustability of the organizer guide rails and end rail simplifies changeovers.

In a further more detailed aspect a microprocessor-based control system can be incorporated allowing presetting and storage for later use of parameters for filling of one or a number of different products and/or container types.

Further advantages obtained by the invention will be apparent with reference to the following detailed description, taken together with the appended drawings.

BRIEF DESCRIPTION OF THE DRAWINGS

So that the way the advantages and objects of the invention are obtained can be more fully described, a particular and specific embodiment or embodiments of the invention are illustrated in the appended drawings. Although one or several embodiments of the invention are illustrated, it will be understood that they are only one or more presently preferred embodiments. The invention is not limited to these specific embodiments in its scope, and the invention will be described and explained with additional specificity through the use of the accompanying drawings in which.

DETAILED DESCRIPTION OF THE PREFERRED EMBODIMENT(S)

Figure 1:
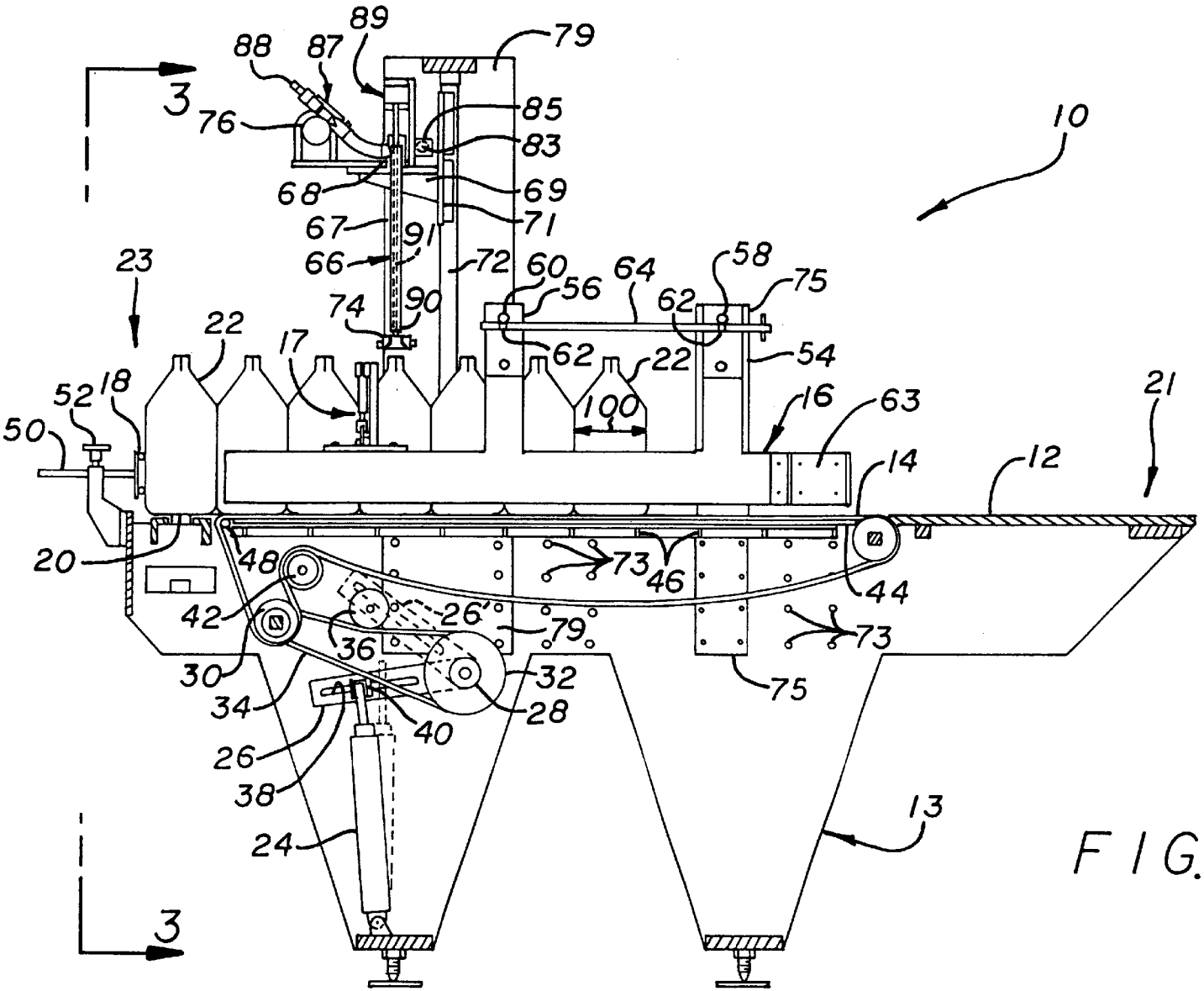
FIG. 1 is a side elevation view, partially in section, of a container feed/filler apparatus in accordance with the invention.

With reference to FIG. 1 of the drawings, a combination container feed and in-line filler system 10 (hereinafter "feed/filler") in accordance with the invention and adapted for food or chemical product packaging use for example facilitates loading empty containers onto a feeder table 12 supported by a frame 13 formed of stainless or mild steel, which containers are carried by a conveyor 14 into a set of guide rails 16 which cooperate with gates 17 and an end rail 18 to organize the containers for filling and subsequent transfer out of the feed/filler by a transverse conveyor 20. The apparatus of the feed/filler system is adapted to bolt up to an existing 4½ inch conveyor for example, but the size of the transverse conveyor can be modified depending on the application and the apparatus can be sized to bolt up to smaller or larger conveyor lines. A chain idler (not shown) is provided to facilitate this connection. The apparatus is painted with an approved paint for food handling equipment or can be unpainted where formed of stainless steel or of a polymeric resin for example, which materials tolerate repeated wash-downs.

The conveyor 14, guide rails 16, gates 17 and end rail 18 together form an organizer system that takes randomized containers, for example bottles 22 and organizes them into files and rows as they move from a first side 21 toward a second side 23 of the feed/filler 10. The guide rails guide the containers into files, and the conveyor pushing the containers up against the end rail and/or gates organizes them into rows. The rows are sequentially moved out of the feed/filler by means of the conveyor pushing them onto the transverse conveyor 20 which then takes them in either of the two directions transverse to the conveyor, depending on how the particular installation of the system. The conveyor moves in index fashion, propelled by an air cylinder 24 adjustably linked to a lever 26 connected by a ratchet and pawl mechanism (not shown) to a hub 28 operatively connected to a conveyor drive spindle 30 by a pulley 32 and link belt 34. The link belt is tensioned by an idler 36. Adjustability in where the cylinder is linked to the lever, facilitated by a slot 38 and tightenable slider 40, allows adjustability in the amount of rotational motion imparted to the hub, and hence translational motion imparted to the conveyor, with each stroke of the air cylinder. The cylinder is reciprocated by a controlled valving arrangement (not shown) in fluid communication with the cylinder 24 and a source of compressed air (not shown). Because of the adjustability in the stroke of the air cylinder different sized containers can be organized for sequential filling into rows as the conveyor indexes them toward the end rail 18, causing them to stack up in the organizer back through the guide rails 16.

Other means of driving the conveyor 14 can be employed, for example a stepper motor (not shown) could be used, or another means such as a hydraulic motor (not shown) in a servo-controlled valved hydraulic circuit, for example alternately allowing or preventing fluid flow which allows or prevents motor actuation by being placed intermittently in fluid communication or denied communication with a source of pressurized fluid and/or a fluid sink. Other servomechanisms and actuation means could alternatively be used, as will be appreciated by those skilled in the art.

The conveyor 14 in the illustrated embodiment is formed of polymer resin links and is conventionally tensioned using a conveyor idler spindle 42 adjacent the drive spindle 30. The conveyor belt is one of the many FDA-approved conveyor belts widely commercially available and is approximately 36 inches wide in the illustrated embodiment. The conveyor belt alternatively can be formed of stainless steel links or wire mesh, or can be a composite design using fiber reinforced elastomeric material for example. As will be appreciated by those skilled in the art, the desired frictional engagement between the conveyor belt and the containers to be filled can be altered by selecting an appropriate belt type.

The conveyor belt 14 is supported by a plate 44 rigidized by stiffeners 46 disposed underneath. The plate can be covered by a low friction material. A lip 48, formed of a low friction material, is disposed so as to support a sharp turn of the conveyor back under the plate 44 to the drive spindle 30. This configuration allows the conveyor 14 to closely abut the transverse conveyer 20 at the second side 23 of the feed/filler so that containers will slide smoothly from the conveyor onto the transverse conveyor.

As mentioned, the position of the tightenable slider 40 is adjusted so that the amount of conveyor belt movement will be enough to stack up the containers, such as bottles 22, against the gates 17 or end rail 18. The position of the gates with respect to the first and second sides 21, 23 is adjustable. The position of the end rail is adjustable also by virtue of support by rods 50 slidable in clamps 52 carried by the support frame 13. This adjustability in gate and end rail position allows for different sized containers to be filled. The amount of belt movement with respect to the size of the containers being filled will depend on the manner in which the system is being operated. As will be discussed below, the system can be set up so that conveyor belt movement is the primary agent whereby containers are made to stack up in rows, or alternatively, it can be set up so that an operator pushing containers onto the feed table, consequently pushing containers ahead into the organizer, is the primary means of pushing containers into a packed arrangement which orders them into rows.

Figure 2:
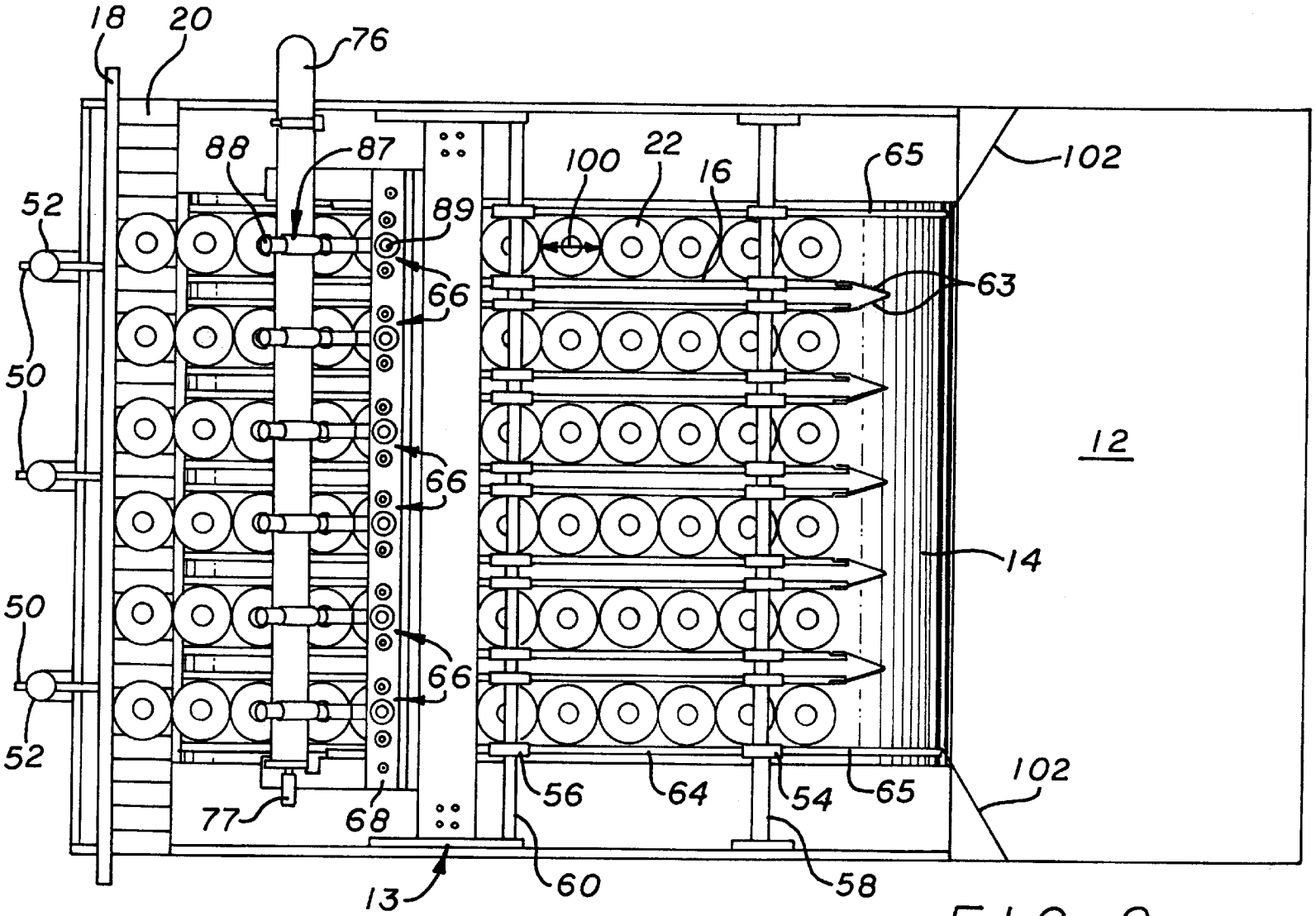
FIG. 2 is a top view of the apparatus shown in FIG. 1.

With reference to FIGS. 1 and 2, adjustability in the set of guide rails 16 is provided. The guide rails are each supported by a pair of sliders 54, 56 carried by horizontal bars 58, 60 in turn supported by the frame 13. The horizontal bars are provided with teeth (not shown) which cooperate with teeth 62 incorporated in a shaft 64 extending through each pair of sliders. By turning the shaft in either rotational direction the position of the guide rail associated with the pair of sliders is adjusted in either direction transverse to the direction of motion of the conveyor 14. Accordingly, the width of spaces between the guide rails is adjustable to accommodate the size of the containers to be filled. Adjacent guide rails are interconnected toward the first end 21 of the feed/filler 10 by hinged plates 63 forming a collapsible V-shape which assists in guiding containers into files in the organizer 14, 16, 17, 18. Edge guide rails 65 need not be interconnected, but are adjustable as well. In an alternate embodiment (not shown) the connection between the guide rails and the sliders 54, 56 is made releasable so that the guide rails are interchangeable for others of different thickness.

Figure 3:
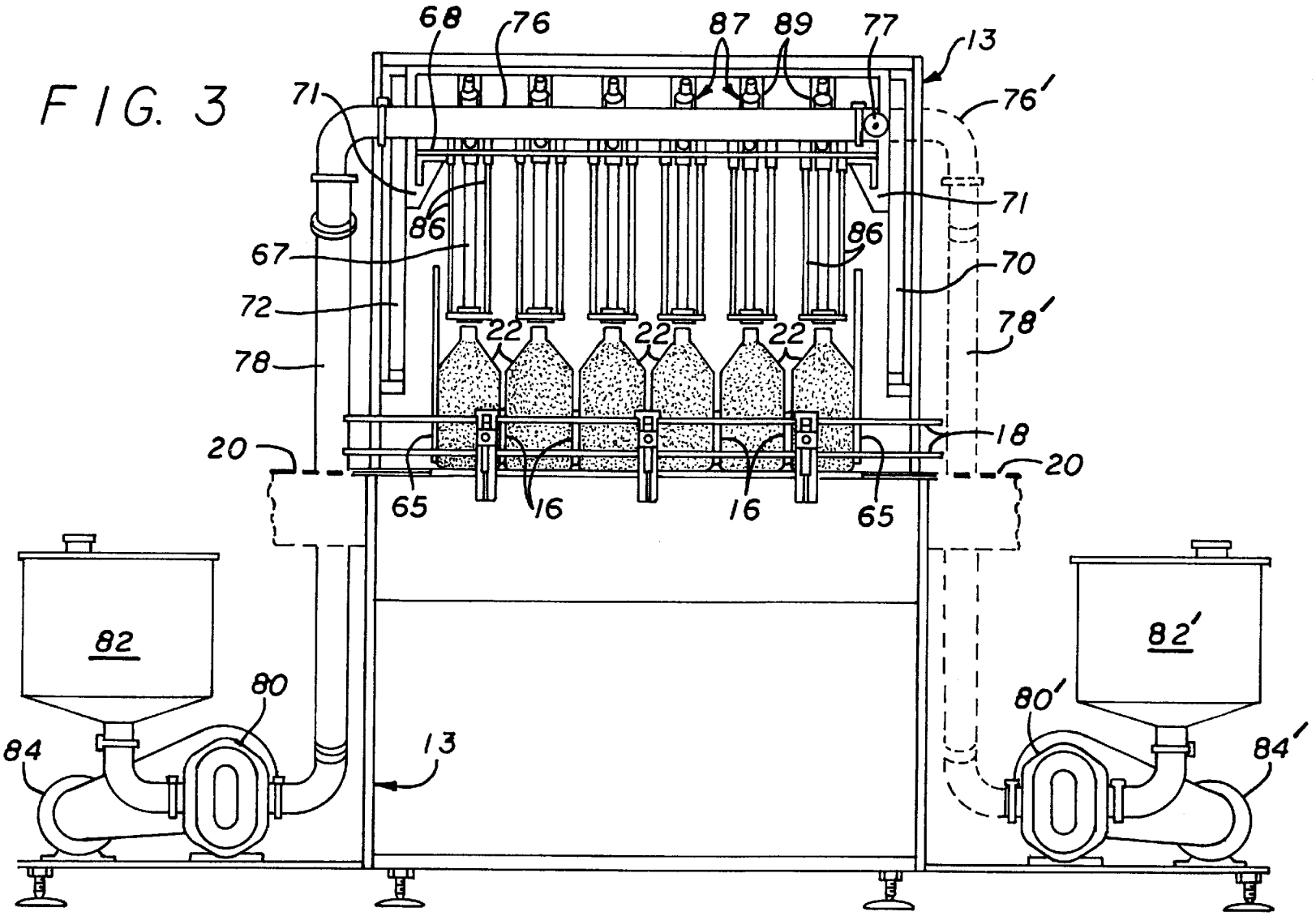
FIG. 3 is an end view taken along line 3—3 in FIG. 1 of the apparatus shown in FIG. 1.

Turning now to FIGS. 1,2 and 3 the operation of each and all of the fillers 66 of a nozzle rack will be appreciated, each being identical to the other in the illustrated embodiment. The fillers are mounted on and carried by a vertically moveable table 68 supported via brackets 69 and vertically actuatable rack member 71 by air cylinders 70, 72. The air cylinders move the shelf up and down thereby raising and lowering the fillers uniformly as one. The air cylinders incorporate position sensors and provide an electronic signal that can be used to very accurately indicate the vertical position of the table. In one embodiment these units are Rodless air cylinders each incorporating a linear encoder to provide very precise position information enabling fine control of vertical position of the fillers. Such cylinders are commercially available, for example model no. 25-2221-20x18.12 manufactured by Origa Corporation of Elmhurst, Ill. is used in one embodiment. In the illustrated embodiment there are 6 fillers provided. Depending on the application more or less fillers can be used, and the width of the feed/filler apparatus can likewise be varied depending on the number of fillers desired and size of the containers anticipated to be filled. Furthermore, the position of the table, and accordingly the position of the fillers, is adjustable in the transverse direction (parallel with the direction of movement of the conveyor 14) in order to provide further adaptability to accommodate different container 22 sizes.

Alternatively, the table carrying the fillers 66 can be actuated with the use of stepper motors or by other servomechanisms, in any case with appropriate gears, racks, links, hydraulic actuation means, etc. and position sensors enabling control of the vertical position. The problem of control of vertical position of the fillers, long recognized and resolved in various ways in the art, can likewise be solved in one of various ways in implementing the present invention.

Each filler 66 includes a centering bell 74 which engages and aligns the container to be filled with a tubular fill nozzle 67 which can extend through the centering bell and top opening of a container down into the container, for example in performing bottom-up filling or fill-to-level operations, enabling a wide range of materials to be filled. The centering bell can be interchangeable so that it can be customized to a particular type of container and/or filling method. As a result, a wide variety of products can be packaged using the apparatus according to the invention. For example materials such as grease, mayonnaise, and other problematic materials such as foamy liquids can be filled from the bottom up. The fillers are fed from a manifold 76 connected by a flexible conduit 78 to a pump, which in one exemplary embodiment is a FDA-approved positive displacement pump 80 drawing from a day tank 82 which in turn is supplied from a larger storage tank (not shown). A pressure gauge 77 is provided to monitor manifold pressure. The pump is powered by an electric motor 84, which in the illustrated embodiment is a 220/460 volt, 3 phase, 60 cycle, wash down type. Other motor types can be substituted. A similar motor can be used to power an air compressor (not shown) used to provide compressed air for operation of the conveyor 14 and fillers 66 and gates 17 for example. Such pumps and motors are widely available commercially. The feed/filler 10 can be equipped with two sets of pumps, day tanks and manifolds so that a rapid changeover in the line is possible. For example such a redundant set including a manifold 76', conduit 78', pump 80', motor 84' and day tank 82' could be rapidly put in service to change over to filling a different product while the first set of components 76, 78, 80, 82, 84 is being cleaned and serviced in preparation for another production run. Accordingly the line can be kept in production nearly continuously, being down only for a brief changeover.

In another embodiment (not shown) a separate positive displacement pump can be employed for each filler 66. Moreover the feed/filler 10 can be adapted, with appropriate modification, to numerous fill methodologies known in the art, for example to: 1) a fill to a level operation; 2) laser fill to a level operation; 3) volumetric (time and pressure) filling; 4) piston pump filling; 5) net weight filling (using load cells under the conveyor 14 at the filler 66 location); 6) flow meter filling; as well as 7) multiple positive displacement pump filling mentioned.

The system allows for considerable variation in application. The fillers 66 can accommodate filling containers 22 requiring considerable vertical travel, this being due to the range of motion of the rodless air cylinders 70, 72. Most containers can be filled, including bottles, tubes, cartridges, as well as containers requiring pucks and other types. Moreover, a nozzle rack support portion 79 of the frame 13, as well as a guide rail support portion 75, each of which is bolted to the remainder of the frame can be moved back and forth by means of additional bolt holes 73 provided so as to allow more or less distance between the fillers and the transverse conveyor 20 at the second end 23. This might be required for example if it is found that one or more additional rows of filled containers 22 of a given product is needed to give sufficient frictional engagement with the conveyor 14 to push the forwardmost row of containers onto the transverse conveyor as the conveyor is indexed.

Each filler 66 includes in addition to the fill nozzle tube 67 which travels with the table 68 sliding rods 86 which can slide with respect to the shelf. These sliding rods carry the centering bells 74 which engage the top of each container to be filled. The sliding rods are biased by gravity or other means such as springs or pressurized gas to a fully downwardly extended position, but can retract upwardly with respect to the table 68. As the filler descends the centering bell first engages the container 22 to be filled. The table and fill nozzle tube continues to descend after the centering bell engages the container, either to the bottom for a bottom to top fill or to a level for a fill to level fill. The centering bell, restrained from further downward movement remains seated on the container, holding the container firmly in place. The rods on either side of the centering bell stop their downward descent also, and the shelf thereafter slides down the rods. After filling the filler is retracted and pulls the centering bell upward at the latter part of its upward motion.

Each filler 66 includes a flow rate control valve 87 actuated by an adjustment knob 88 for controlling the rate of filling in all filling methodologies. They are particularly useful in volumetric filling where control of flow rate is critical. By adjusting the valves for a particular flow rate at a given pressure volumetric filling can be done. These valves allow creation of a pressure differential between the manifold and each filler and compensation for pressure differential in the manifold between the filler closest to the pump 80 and the one farthest away for example, which might otherwise affect filling. These valves can be used to fine-tune the amount of product dispensed by each filler during each filling cycle for example to equalize the level in each filled container 22.

Each filler 66 also includes a valve actuator 89 which actuates a valve 90 at the tip of each filler nozzle tube 67 by means of a rod 91 extending through the nozzle tube. These valve actuators comprise air cylinders connected to a source of compressed air (not shown) through conduits and control actuated valving (not shown) which applies air pressure to open or close the valve 90 by actuating the cylinder in timed coordination with other feed/filler system 10 actions. Mechanical adjustment of the amount the valve opens is possible by adjustment of how far the actuator is allowed to move, to accommodate products of different viscosities for example. The valves are thus individually adjustable to account for small differences in individual fillers.

Each filler also incorporates a container sensor (106 in FIG. 7) for sensing if and when a container is under the filler. This is a sensor that senses when the sliding rods 86 move with respect to the table 68 as the table is lowered, indicating that a centering bell 74 has contacted a container. If no container is under the filler when it is lowered then the sliding rods for that filler will not move with respect to the table as the centering bell will not be restrained from downward movement by a container. In this way a controller (not shown) will be alerted that there is no container under a filler and that filler can be made to refrain from filling.

In one embodiment for example when the sliding rods 86 move with respect to the table 68 to a predetermined point they push a flag comprising a small metal plate 85 out of a beam of light 83 positioned to pass adjacent each and all of the fillers. The flag is biased to a position interrupting the beam, and if even one centering bell 74 does not encounter a container 22 in position for filling the sliding rod will not move to the preset position and the flag for that filler will not move out of the beam and will continue to intercept the beam. If all centering bells engage a container all flags will clear the beam and a photosensor 81 disposed to intercept the beam after it passes all the fillers will send a signal which will indicate that all fillers have containers underneath, and all valves 90 can be opened to dispense product. As can be appreciated in another embodiment each filler could be independently actuated to open and close independent of other fillers, and an individual sensor for sensing whether a container is positioned under each filler can be provided. Such a sensor could comprise for example a simple switch actuated when the sliding rod 86 reaches a particular point in its upward movement with respect to the table 68.

Filling operations are controlled and coordinated with movement of the conveyor 14. This can be done using a microprocessor-based control means or can be accomplished with timing circuits or by mechanical means. In any case the process proceeds in one of four ways as will be discussed in turn below.

Figure 4:
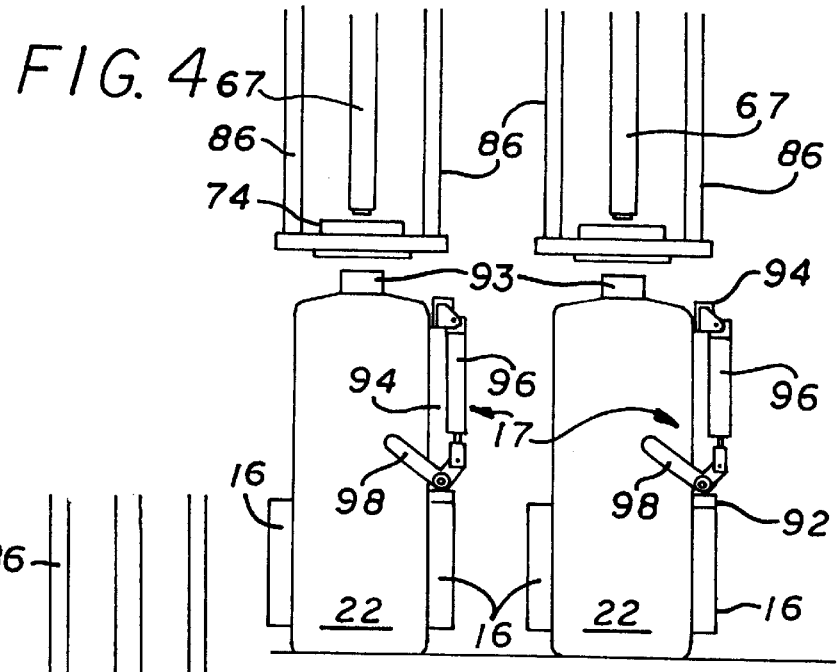
FIG. 4 is an elevation view of a gate portion of the apparatus showing the gates closed.
Figure 5:
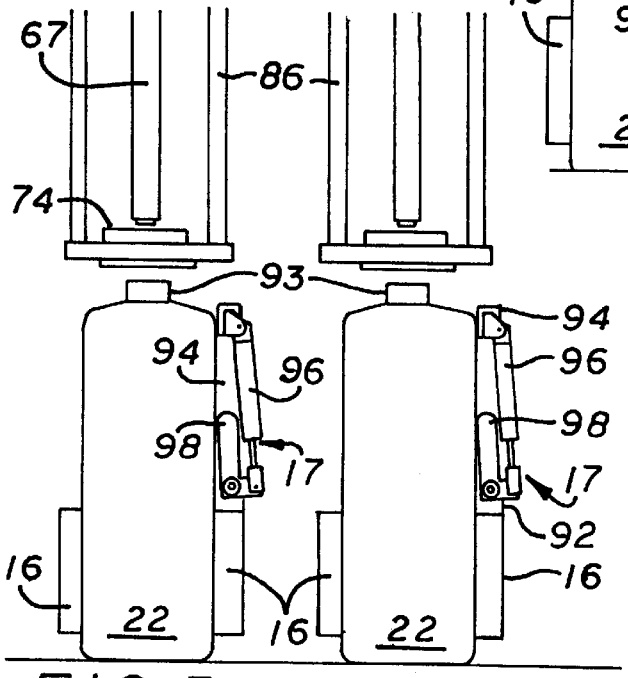
FIG. 5 is an elevation view of the gate portion shown in FIG. 4 with the gates in an open position.
Figure 6:
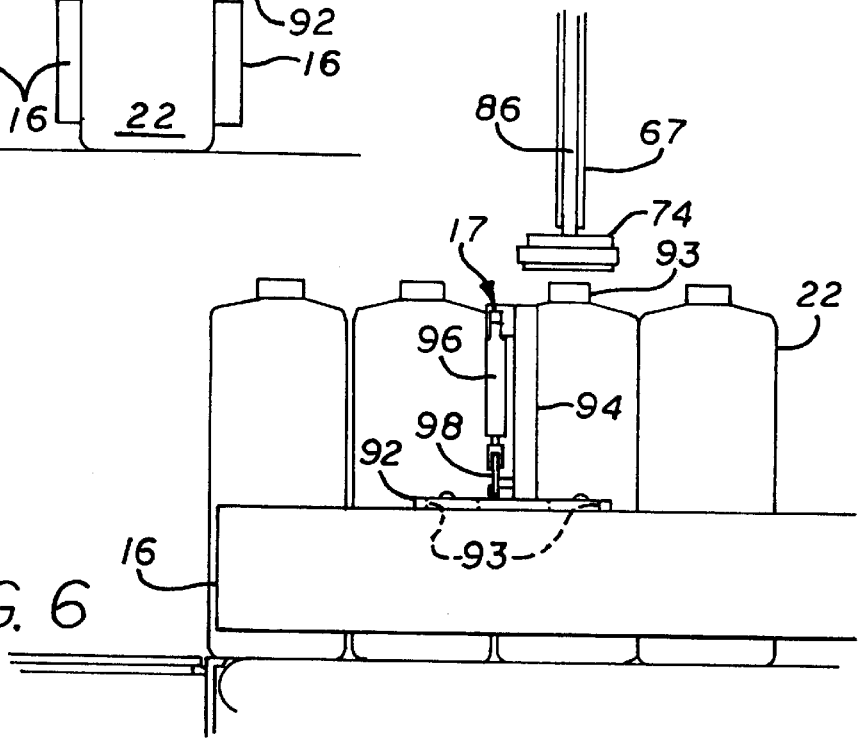
FIG. 6 is a side elevation view of the gate portion shown in FIG. 4.

In a first mode of operation the gates 17 are used to organize the containers into rows during filling operations. With reference to FIGS. 4, 5 and 6, a gate 17 is provided for each file of containers at a location just downstream of the fillers 66. Each gate is mounted on a organizer rail 16 by means of a base plate 92 which incorporates slots 93 allowing front to back adjustment in location with respect to the fillers 66. The position is set based upon the size of container being filled so that a mouth 93 of the container 22 will be centered underneath a filler nozzle tube 67 when the container is pushed up against the gate. All the gates are located the same distance from the fillers so that as the containers stack up against the gates they are organized into rows. As mentioned, a nozzle rack comprising the fillers 66 carried by the table 68 is also adjustable in the direction of movement of the containers 22 with respect to the frame 13. Accordingly the location of filling is adjustable as well. Each gate further comprises a vertical member 94 carried by the base plate. The vertical member pivotably carries an air powered piston actuator 96. The actuator is pivotably connected to a gate member 98 in each case, the gate member being pivotably carried by the base plate 90. Flexible air conduits (not shown) connect each actuator to an air valve (not shown) controlled by a system controller (not shown) which applies air pressure to the appropriate side of each air powered piston actuator to open or close the gate, respectively.

With reference to FIGS. 1, 2 and 3, an operator (not shown) when initially filling the is feed/filler 10 with containers 22 prior to start pushes them up against the gates 17 which default to a closed position. After commencement of filling operations the conveyor on each stroke of the lever 26 indexes the conveyor 14 by an amount at least as great as the diameter 100 (or length or width for a square container) for example of a bottle plus the thickness of the gate member 98. After the just-filled container passes the gate 17 it closes, pushing the empty containers back. The empty containers slide more easily on the conveyor than the filled containers, which resist slipping because of the weight of their contents. The filled containers push the first row toward and onto the transverse conveyor 20 with each indexing of the conveyor. The transverse conveyor carries them away to capping and labeling as mentioned. The transverse conveyor can operate continuously or can be made to stop and start coordinated with the conveyor 14. It may be beneficial to start moving the transverse conveyor slowly and thereafter build up speed, being careful not to apply too much acceleration to the filled containers, lest some of the contents slosh out. Thereafter, the operator simply loads containers onto the feed table 12 and pushes them forward to stack up against the gates. Wings 102 are provided adjacent the outer guide rails 65 to facilitate loading and pushing empty containers up against the gates 17. In this way the gates prevent the operator from pushing containers beyond the fillers 67, which can result in empty containers being pushed out onto the line and perhaps even going out to customers.

In a second embodiment the gates 17 are used only at start up, to make sure no empty containers are passed out onto the line. Thereafter the operator or the conveyor 14 pushes the containers up against the resistance of the filled containers at the second side 23; or, alternatively, pushes all containers, filled or empty, up against the end rail 18. The conveyor indexes by at least one diameter 100 at each stroke in this second methodology. If the apparatus is operated in this way the gates can be operated in a discretional mode where they close or open by an operator manually actuating a switch, for example to hold the containers while several rows accumulate behind the fillers 66.

In a third way of operation the conveyor 14 pushes the containers 22 against the gates 17 to organize them into rows. In this methodology the conveyor indexes by more than the diameter 100 plus the thickness of the gate member 98. The operator simply loads containers onto the conveyor, which takes them from there and packs them into rows by moving underneath them after they are stacked up against each other. The filled containers also stack up against the end rail 18, preventing the second row and subsequent rows from advancing and reaching the conveyor until the first row, stacked against the end rail and positioned on the transverse conveyor 20, is moved out onto the line.

In a forth mode of operation the gates 17 again only function at the start of a production run to insure no empty containers 22 go out onto the line. After starting the feed/filler the conveyor indexes by the container diameter only until the first containers are up against the end rail 18. Thereafter the system operates in a manner similar to that just described in connection with the third way of operation but stacks the containers up against the end rail 18, thereby organizing them into rows.

Figure 7:
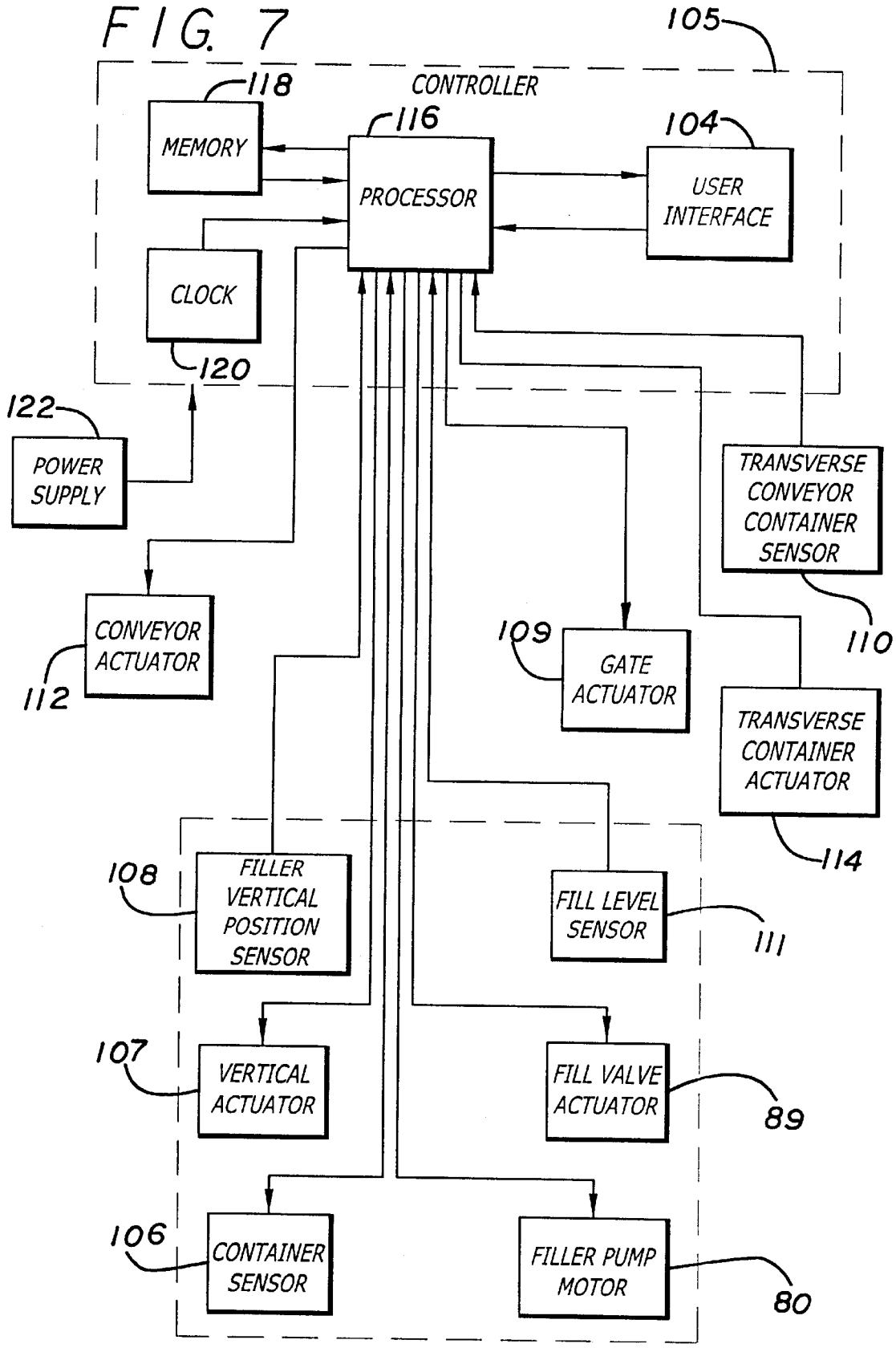
FIG. 7 is a schematic block diagram illustrating the principles of operation of an exemplary control system for the apparatus shown in the FIGS. 1–6.

With reference to FIGS. 1 and 7 operation and control of the system in an exemplary embodiment will be described. When feed/filler 10 is loaded with bottles, the distance the conveyor 14 will move each time it is indexed is adjusted, and filling operation parameters such as which fillers 66, if any, are turned off, filler pump 80 RPMs, filler tube 67 down speed and up speed, where to fire air cylinders comprising the filler valve actuators 89 to open and close the valves 90 at the bottom of the filler nozzle tubes 67, final retract height for the filler nozzle tubes, and the like are entered by means of a user interface 104 of a controller 105, the operator pushes a cycle start button on the user interface. The user interface can comprise a key pad (not shown) or touch screen or dials or other means to input information, and can include a display (not shown) to convey information to the operator. After entry of the parameters, or recall of a preprogrammed set of parameters, the nozzles drop to a bottom position by actuation of a vertical actuator 107 which can comprise for example the rodless air cylinders 70, 72 and valving controlled electronically. If all active fillers sense by means of container sensors 106 that a container is under each filler the process continues. If not, the fillers fully retract and signal the operator and wait for another cycle start signal given by the operator pressing for example a cycle start button on the user interface. The filler valve actuators 89 fire and open the filler valves 88, the pump 80 is turned on, and the containers are filled as the nozzle rack comprising the fillers mounted on the table 68 rises by means of the air cylinders 70, 72. Vertical position information concerning the filler tubes is fed to the controller by a filler vertical position sensor 108, which in the illustrated embodiment is an encoder integral with the air cylinders comprising actuators 70, 72 which move the table 68 up and down. In one embodiment a fill level sensor 111 senses when a preselected level is reached. This can be for example a laser sensor mounted adjacent each filler, or in applications where the bottom of the fill tube can be lowered to the desired fluid level it can be a pressure transducer sensing a pressure change when fluid reaches the bottom of the fill tube, for example. The pump 80 then is stopped and the filler valves 90 close and then the filler nozzle tubes 67 fully retract. The gates 17 open by means of gate actuators 109 which can comprise electronically controlled air valves controlling air to and from the piston actuator 96 of the gates described above. The conveyor 14 indexes one row of containers 22 by actuation of the conveyor actuator 112, which can comprise an electronically controllable air valve and source of compressed air as discussed above, and the air cylinder 24 shown. Then the transverse conveyor 20 is actuated by an actuator 114 which can comprise an electric motor for example, and carries off one row of containers. The cycle repeats unless a cycle stop button is depressed since the beginning of the cycle, whereupon the cycle stops.

A transverse conveyor container sensor 110, comprising in one embodiment a proximity sensor sensing when a container passes, enables the controller 105 to sense when all six (or some other number if more or less fillers 66 are used) containers have passed out onto the line via the transverse conveyor 20. The transverse conveyor can alternatively be run continuously or intermittently depending on the application.

In order to provide the control functions mentioned, the controller 105 comprises a processor 116 interacting with the other components as shown and with a memory 118 which in a presently preferred embodiment is a non-volatile memory enabling one or more set of system set-up parameters as mentioned above to be stored. This enhances the facilitation of rapid changeovers from one product being packaged to another. A timing function is also required and a clock 120 is provided. An appropriate power supply 122 is provided.

The user interface 104 can include a display as mentioned, which can be a cathode ray tube or a liquid crystal display, which can show information imputed and system status for example. Operation of the system can be simplified by programming stored in the memory 118, allowing prompting for input of system parameters to be used or selection of a previously stored set of parameters.

As can be appreciated, considerable variation in the specifics of implementation of the invention is possible. As mentioned timing circuits, with adjustment of parameters accomplished for example by adjustment of potentiometers or switches in combination with mechanical adjustment could be used. Compressed air actuation can be replaced by hydraulic actuation. Also for example, instead of air actuation of the conveyor 14 by means of an air cylinder 24, lever 26, etc. or a hydraulic actuator, a stepper motor could be employed, or a motor and gear train with a counter which stops the motor and resets after an adjustable number of shaft rotations of the motor has been reached. In another possible variation a notched circular plate attached to a shaft with a means to count the number of notches passing by a specific point could be employed, thereby enabling very precise control particularly if the shaft turning the plate is an input shaft of a gear train and the output shaft to the conveyor is geared down to a much lower speed of rotation. Numerous other variations will suggest themselves to one skilled in the art.

Figure 8:
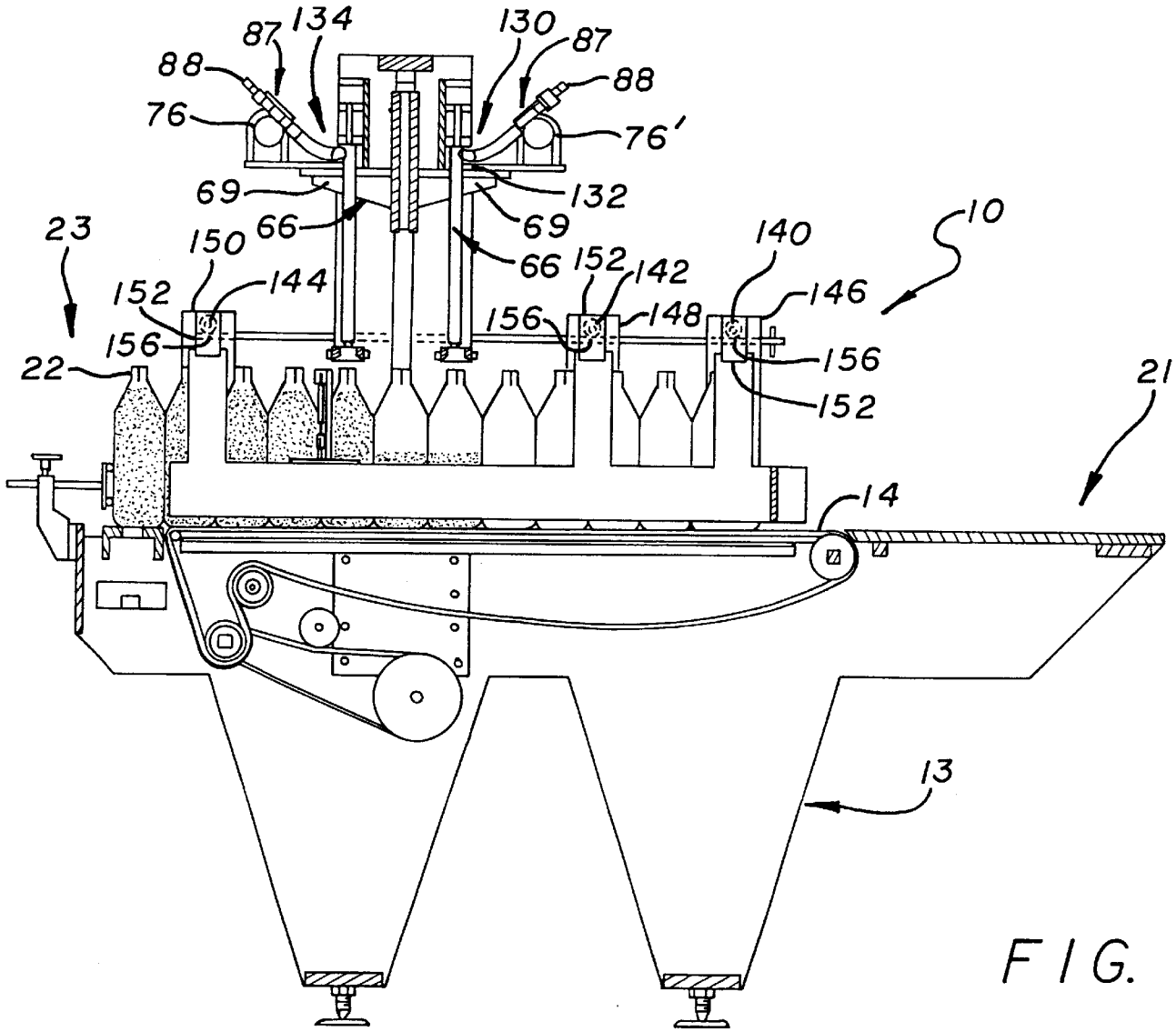
FIG. 8 is a side elevation view of another embodiment of the invention.
Figure 9:
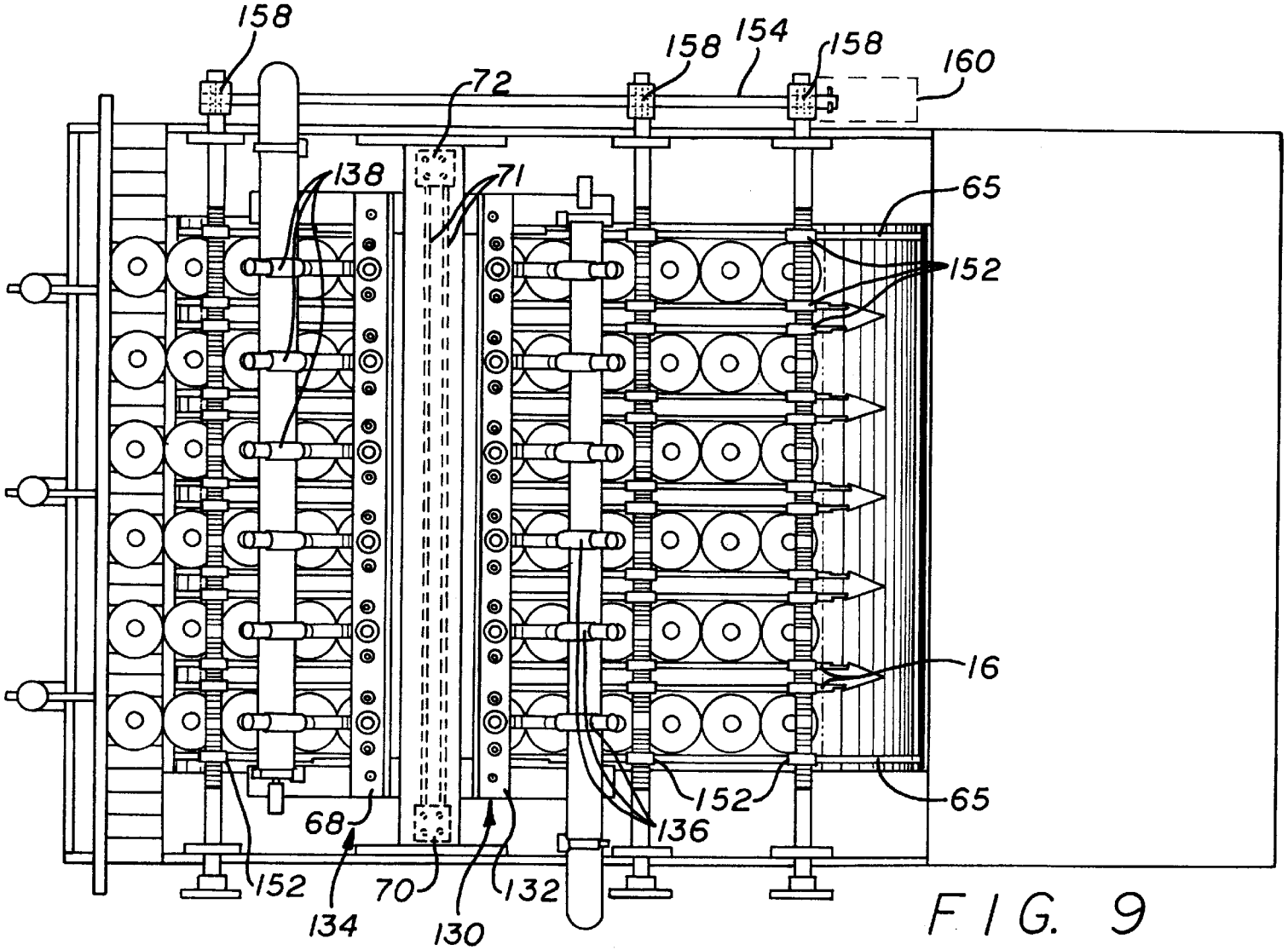
FIG. 9 is a top view of the apparatus shown in FIG. 8.

With reference to FIGS. 8 and 9 for example in another embodiment a second nozzle rack 130 is provided, substantially identical to that described above and including the same number of fillers 66 mounted in line with and in mirror image relation to those described above so as to simultaneously fill containers in another row. This second nozzle rack for example is carried by a table 132 supported and actuated vertically up and down by the rodless air cylinders 70, 72 as before described. The second nozzle rack 130 is fed by a second manifold 76', flexible conduit 78', pump 80' and day tank 82' as before described, except they can in this configuration be run simultaneously with those same counterpart elements 76, 78, 80, 82 supplying the first set of fillers 66.

This configuration allows the option of a two-part filling operation, for example oil and vinegar in the same bottle container 22. As the bottle is moved by the conveyor 14 from the first side 21 toward the second 23 the fillers of the first nozzle rack 130 partially fills it with one product, and the second nozzle rack 134 encountered fills the balance with a second product.

The configuration would also allow the feed/filler 10 to fill two different products at the same time. Each nozzle rack would have only half its fillers 66 operational, for example by closing 3 flow control valves 87 and disabling the sensing apparatus described above with respect to these fillers as required. For example a first group 136 of fillers would fill containers with a first product and a second group 138 would fill a second product.

In this embodiment capacity can also be increased by using both nozzle racks 130, 132 simultaneously to fill the same product. In this mode of operation the conveyor is indexed alternately one and three times between each time the fillers 66 are lowered for filling. This is because every other time the fillers are lowered two rows of filled containers will be stacked up behind the nozzle rack 134 closest to the second end 23, having been filled by the other nozzle rack 130 closest to the first end 21.

Also, if one row of containers 22 at a time is filled product changeovers can be nearly instantaneous as one product can continue to be filled through one nozzle rack 130 for example, fed by one manifold 76' for example, while the other set 134, 76 is being installed and readied to be put into production after cleaning for example.

Furthermore in another embodiment the task of adjusting the positions of the guide rails can be simplified, or alternatively automated, by employing a scheme as illustrated in FIGS. 8 and 9. Support rods 140, 142, 144 are rotatably supported by guide rail support portions 146, 148, 150 of the frame 13, all moveable as before described in conjunction with the nozzle rack support portion 79 of the frame with respect to the remainder of the frame. The support rods are threaded in segments of alternating left and right turning cooperating with threaded blocks 152 likewise alternatively threaded so that as the support rods are turned the guide rails 16, 65 are simultaneously moved closer or farther away from each other, reversing direction with a reversal of direction of rotation of the support rods. This can be coordinated by providing a shaft 154 which includes threaded segments 156 that act as worms in turning the support rods by means of splines 156 engaged by the worms. This worm-gear arrangement can be manually turned with a special tool (not shown) or a motorized drive 160 shown schematically can be provided, enabling the process of adjusting the guide rails to facilitate filling a particular sized container 22 to be automated, for example using the controller 105 mentioned above and an encoder (not shown) configured to sense position of at least one of the support rails or alternatively the amount of rotation of at least one support rail. Since all the guide rails and support rods are tied together sensing one accounts for all.

It will be appreciated that a feed/filler 10 according to the invention provides advantages in packaging products by combination of the organizing function of a container feeder with that of a filler. Economies can be realized through elimination of waiting time for containers to feed in and out of a separate filler, as well as in product and container changeovers, for example, using equipment made in accordance with the invention.

While certain particular forms of implementation of the invention have been described, it will be understood that much variation can be made without departing from the spirit and scope of the invention and the fair meaning of the appended claims. The scope of the invention is not intended to be limited except as set forth in the appended claims.

What is claimed is:

1. A container feed and in-line container filler system, comprising:

a support frame;

a conveyor carried by the frame, the conveyor moving randomized containers in a first direction from a first side toward a second side;

an organizer, supported by the frame, further comprising a set of guide rails which line up containers in files as the containers move in the first direction and a stop preventing further motion of the containers in the first direction, the stop cooperating with the conveyor and guide rails to pack the containers into rows;

a filler supported by the frame and positioned over the organizer, whereby containers are filled as they are organized into rows and files and moved through the organizer;

a feed table adjacent the first end of the conveyor; and a transverse conveyor configured for moving containers out from the system one row at a time.

2. The container feed and in-line container filler system of claim 1, further comprising a feed table adjacent the first end of the conveyor.

3. The container feed and in-line container filler system of claim 1, further comprising a plurality of fillers aligned in a first row facilitating filling of one row of containers simultaneously.

4. The container feed and in-line container filler system of claim 3, further comprising a plurality of fillers aligned in a second row facilitating simultaneous filling of two rows of containers.

5. The container feed and in-line container filler system of claim 1, wherein the stop comprises an end rail adjacent the transverse conveyor.

6. The container feed and in-line container filler system of claim 1, where filled containers push containers ahead onto the transverse conveyor as the conveyor is advanced toward the second end.

7. The container feed and in-line container filler system of claim 1, wherein the stop comprises a gate configured to selectively alternatively prevent and allow movement of the containers past the gate.

8. The container feed and in-line container filler system of claim 1, further comprising a first filler pump and manifold adapted to move fluid to the filler for filling under pressure and further comprising a second filler pump and manifold, facilitating servicing the first pump and manifold while the second pump and manifold is in operation.

9. The container feed and in-line container filler system of claim 1, further comprising adjustable supports, carried by the frame, for the guide rails which allows for adjustment in the position of the guide rails to accommodate variations in container size.

10. A container feed and in-line container filler system, comprising:

a support frame a conveyor carried by the frame, the conveyor moving randomized containers in a first direction from a first side toward a second side;

an organizer, supported by the frame, further comprising a set of guide rails which line up containers in files as the containers move in the first direction and a stop preventing further motion of the containers in the first direction, the stop cooperating with the conveyor and guide rails to pack the containers into rows;

a plurality of fillers supported by the frame and positioned over the organizer, whereby containers are filled row-by-row as they are organized into rows and files and moved through the organizer; and, a transverse conveyor adjacent the second end of the conveyor, each successive row of containers arriving at the transverse conveyor being urged onto the transverse conveyor by at least one row of filled containers behind.

11. The container feed and in-line container filler system of claim 10, wherein the stop comprises an end rail adjacent the transverse conveyor.

12. The container feed and in-line container filler system of claim 10, wherein the stop comprises a gate for each file configured to selectively alternatively prevent and allow movement of the containers past the gate.

13. The container feed and in-line container filler system of claim 12, wherein the gate is carried by a guide rail.

14. The container feed and in-line container filler system of claim 10, further two filler pumps and two manifolds supplying product to be filled into the containers to the fillers, whereby one pump and manifold can be serviced while the other is in operation.

15. The container feed and in-line container filler system of claim 10, further comprising a microprocessor-based control system facilitating control of container feed and filling operations according to pre-selected process step parameters.

16. The container feed and in-line container filler system of claim 10, wherein the position of the filler with respect to the second side is adjustable, so that the distance from the filler to the transverse conveyor is variable.

17. The container feed and in-line container filler system of claim 10, wherein a distance between the filler and the transverse conveyor will accommodate at least two rows of containers fillable by the system.

18. A container feed and in-line container filler system, comprising:

a support frame a conveyor carried by the frame, the conveyor moving randomized containers in a first direction from a first side toward a second side;

an organizer, supported by the frame, further comprising a set of guide rails which line up containers in files as the containers move in the first direction and a plurality of gates comprising a stop alternatively allowing and preventing further motion of the containers in the first direction, the stop cooperating with the conveyor and guide rails to pack the containers into rows;

a feed table adjacent the first side of the conveyor;

a plurality of fillers supported by the frame and positioned over the organizer, whereby containers are filled row-by-row as they are organized into rows and files and moved through the organizer; and a transverse conveyor adjacent the second end of the conveyor, each successive row of containers arriving at the transverse conveyor being urged onto the transverse conveyor by at least one row of filled containers behind.

19. The container feed and in-line container filler system of claim 18, further comprising a positionally adjustable end rail adjacent the transverse conveyor and an adjustable set of guide rail supports facilitating adjustment of the spacing between guide rails allowing the filling of different sized containers with the system.

20. The container feed and in-line container filler system of claim 18, wherein a distance between the fillers and the transverse conveyor is at least as large as needed to accommodate two rows of containers fillable by the system.

* * * * *